US007413523B2

(12) United States Patent
Lu

(10) Patent No.: US 7,413,523 B2
(45) Date of Patent: Aug. 19, 2008

(54) FOLDABLE BASKETBALL STAND

(76) Inventor: Lien-Fu Lu, 235 Chung-Ho Box 8-24, Taipei (TW)

( * ) Notice: Subject to any disclaimer, the term of this patent is extended or adjusted under 35 U.S.C. 154(b) by 79 days.

(21) Appl. No.: 11/353,195

(22) Filed: Feb. 14, 2006

(65) Prior Publication Data

US 2007/0191150 A1 Aug. 16, 2007

(51) Int. Cl.
*A63B 63/08* (2006.01)

(52) U.S. Cl. ..... 473/481; 473/479

(58) Field of Classification Search ..... 473/479–485
See application file for complete search history.

(56) References Cited

U.S. PATENT DOCUMENTS 3,399,889 A * 9/1968 Harry ..... 473/481
3,716,234 A * 2/1973 Lancellotti ..... 473/481
4,036,494 A * 7/1977 Hayes ..... 473/481
5,800,294 A * 9/1998 Naecker, Jr. ..... 473/481

OTHER PUBLICATIONS

Webpage download, CPSC, 2002,www.cpsc.gov/cpscpub/prerel/prhtm102/02129c.jpg, 1 page.*
Webpage download, epscientific datasheet, 2002, www.epscientific.com/product/images/pg10-1galcubes_350.jpg,6 pages.*

* cited by examiner

*Primary Examiner*—Gene Kim
*Assistant Examiner*—M Chambers

(57) ABSTRACT

A foldable basketball stand comprises a seat having a supporting frame, a transfer unit installed at one end of the supporting frame and a weight installed to the supporting frame; and the weight being a foldable water box; a supporting unit formed of a plurality of rod bodies; one end of the supporting unit being connected to the transfer unit of the seat; and a backboard installed at another end of the supporting unit; and the backboard having at least two plate bodies and a hoop installed between the two plate bodies. The installation of the seat, supporting unit and backboard causes the foldable basketball stand can be assembled easily for use and detached easily for storage. Thereby the volume of the foldable basketball stand is small. It can be storage and transferred easily and conveniently.

1 Claim, 7 Drawing Sheets

FOLDABLE BASKETBALL STAND

FIELD OF THE INVENTION

The present invention relates to basketball stands, and in particular to a foldable basketball stand, wherein the installation of the seat, supporting unit and backboard causes the foldable basketball stand can be assembled easily for use and detached easily for storage. Thereby the volume of the foldable basketball stand is small. It can be storage and transferred easily and conveniently.

BACKGROUND OF THE INVENTION

The prior art backboard is formed of a plurality of metal rods which are connected together. One end of a supporting frame is connected to a backboard. A hoop is installed to the backboard. Another end of the supporting frame is installed with rollers. Thereby the basketball stand can be installed to a predetermined position.

The prior art basketball stand can be installed to a predetermined position, but the metal rods have larger diameters and are connected by welding. The basketball stand is moved by using a hanging machine. Thus it is not suitable for a small area. Thereby it is difficult to move the basketball stand and thus it is not suitable to adjust the position of the basketball stand. Further, the supporting frame, backboard and hoop of the basketball stand are difficult to be detached.

An improved basketball stand is developed. The basketball stand is formed of a seat including a water box or a concrete structure, a rod body connected to the seat, a backboard on the rod body, and a hoop on the backboard. This improved structure can be installed to a small area. However the seat, rod body, backboard and hoop cannot be detached. Since the components of the basketball stand are not detachable, the volume is great. Thus, it is inconvenient to transfer or store the basketball stand. Thus the prior art basketball stands are not practical.

SUMMARY OF THE INVENTION

Accordingly, the primary object of the present invention is to provide a foldable basketball stand, wherein the installation of the seat, supporting unit and backboard causes the foldable basketball stand can be assembled easily for use and detached easily for storage. Thereby the volume of the foldable basketball stand is small. It can be storage and transferred easily and conveniently.

To achieve above objects, the present invention provides a foldable basketball stand which comprises a seat having a supporting frame, a transfer unit installed at one end of the supporting frame and a weight installed to the supporting frame; and the weight being a foldable water box; a supporting unit formed of a plurality of rod bodies; one end of the supporting unit being connected to the transfer unit of the seat; and a backboard installed at another end of the supporting unit; and the backboard having at least two plate bodies and a hoop installed between the two plate bodies.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
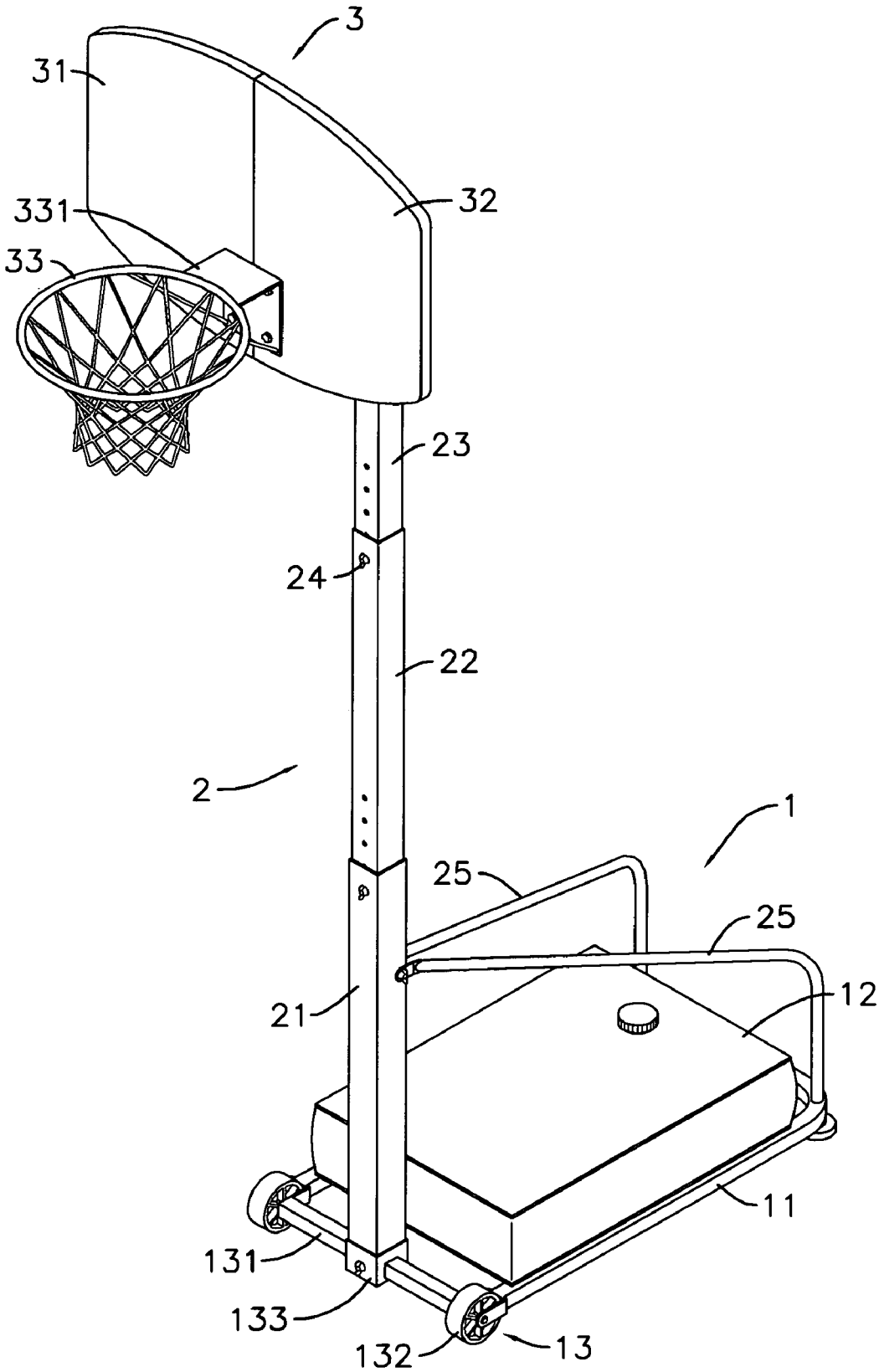
FIG. 1 is a schematic view of the present invention.
Figure 2:
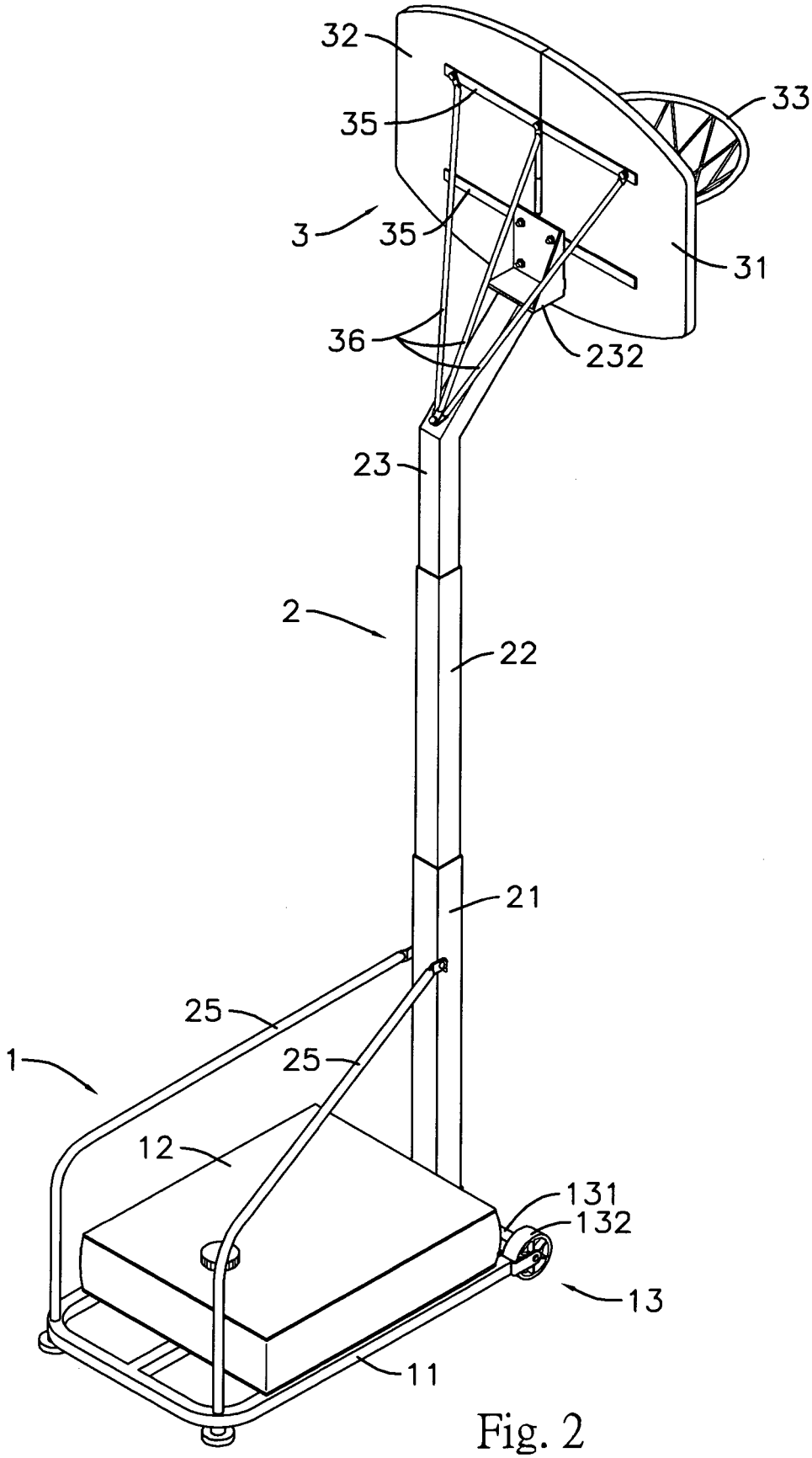
FIG. 2 is a schematic view of the present invention which is viewed from another orientation.
Figure 3:
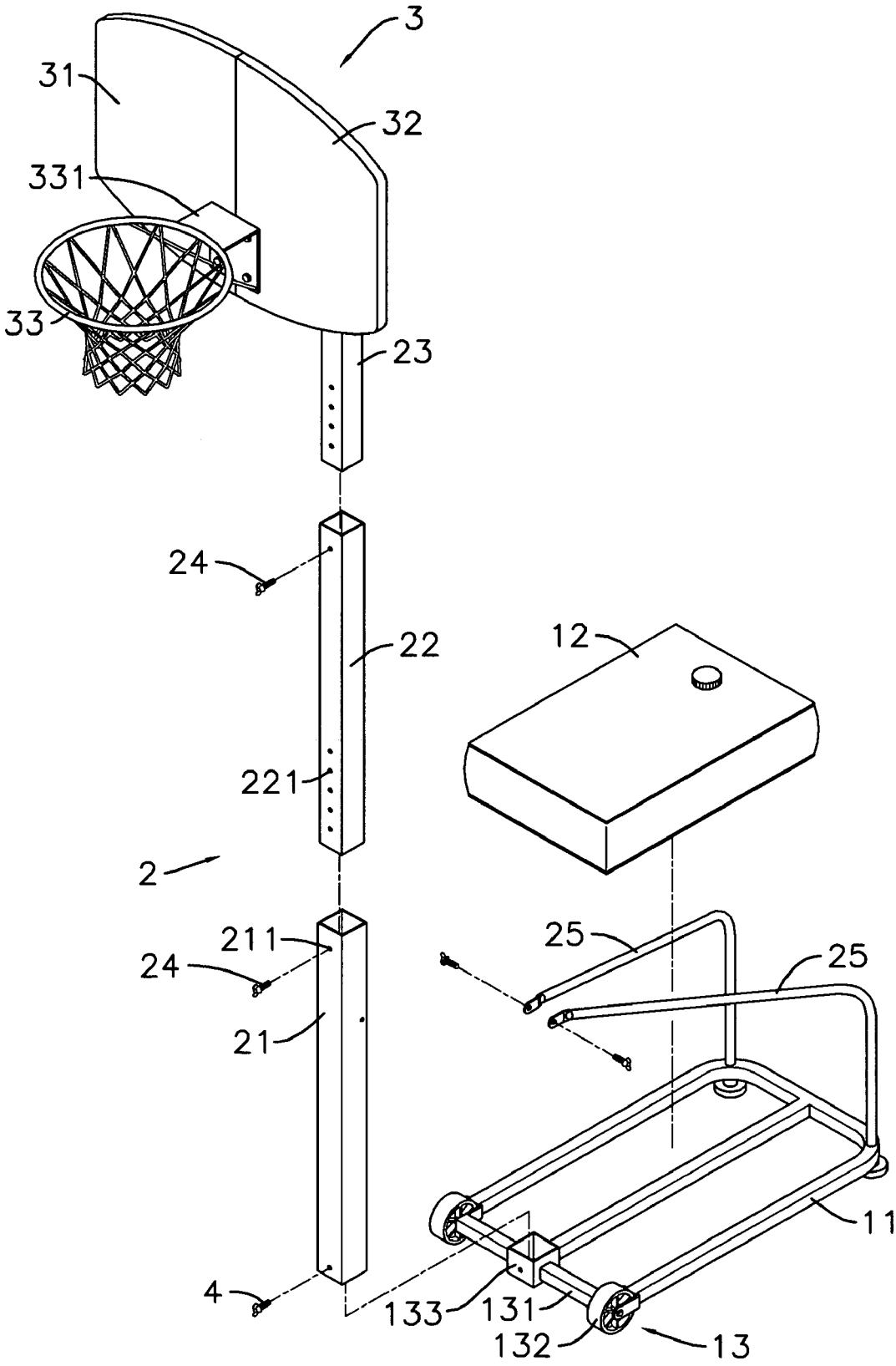
FIG. 3 is an exploded view of the present invention.
Figure 4:
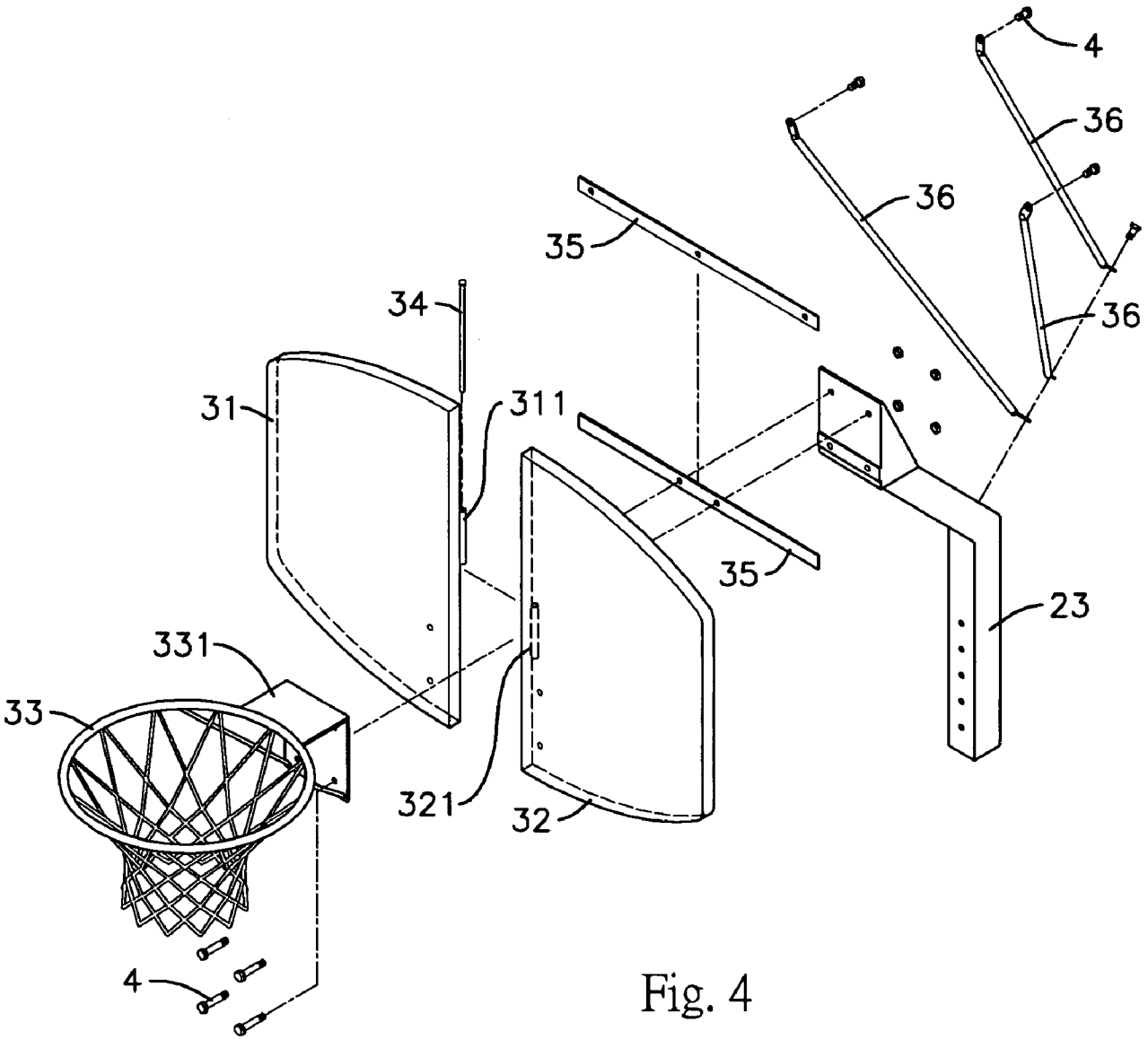
FIG. 4 is an exploded schematic view of the present invention.
Figure 5:
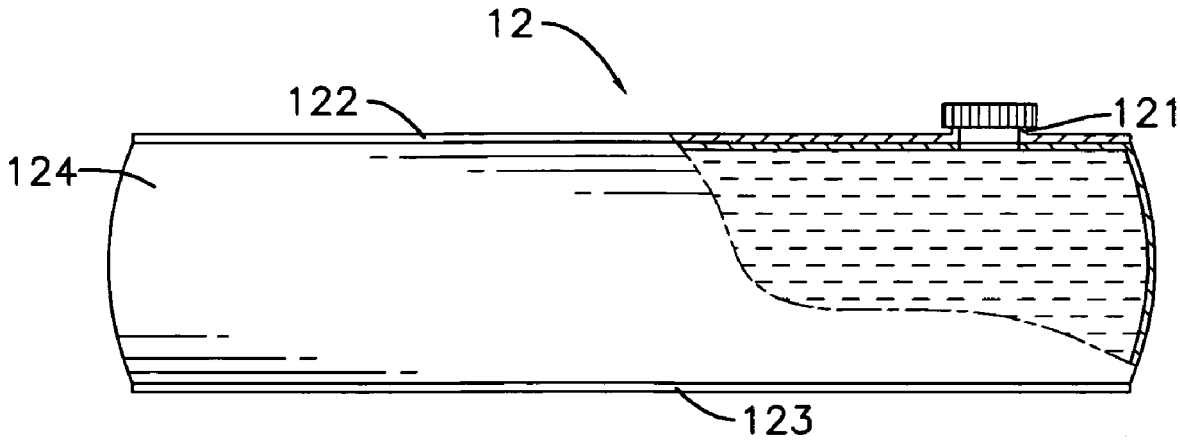
FIGS. 5 and 6 are schematic views showing the use of the weight of the present invention.
Figure 6:
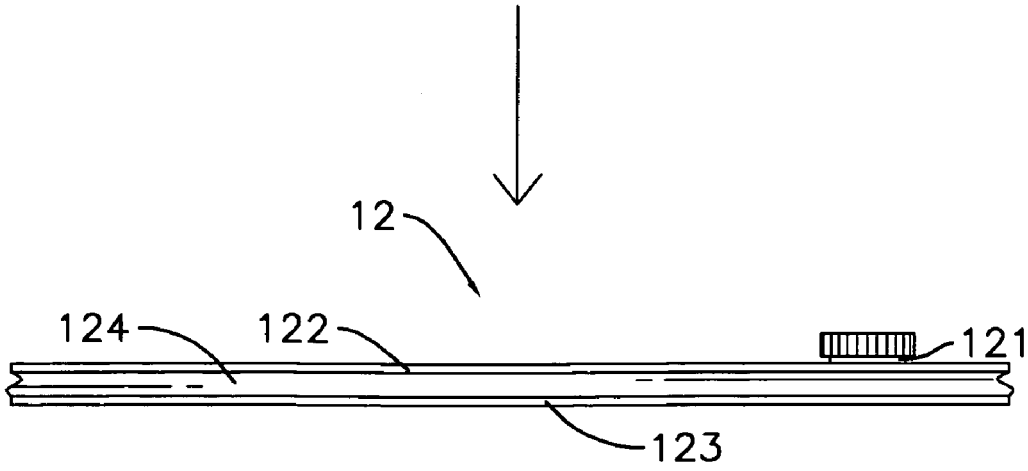

Referring to FIGS. 1 to 6, the structure about the foldable basketball stand of the present invention is illustrated. The present invention has the following elements.

A seat 1 has a supporting frame 11 and a weight 12 installed on the supporting frame 11 and a transfer unit 13 installed on the supporting frame 11. The weight 12 is a water box formed of an upper hard plate 122, a lower hard plate 123, a middle soft plastic plate 124, a water inlet 121. The water box is foldable. The transfer unit 13 has a retaining rod 131. Two ends of the retaining rod 131 have wheels 132. A center of the retaining rod 131 has an assembly portion 133.

A supporting unit 2 is formed of a plurality of rod bodies 21, 22, 23 (in this embodiment, three rod bodies are used, but the present invention is not confined to three rod bodies). The rod bodies 21, 22, 23 are connectable one by one. One sides of the rod bodies 21, 22, 23 are formed with respective through holes 211, 221, 231. A pin 24 serves to connect the first rod body 21 and the second rod body 22, and a pin 24 serves to connect the second rod body 22 and the third rod body 23. The first rod body 21 is connected to the assembly portion 133 of the transfer unit 13. One end of the third rod body 23 is connected to a connection portion 232 of a backboard 3. Two sides of the supporting frame 11 of the seat 1 have respective supporting bars 25 for being connected to the supporting unit 2.

A backboard 3 is installed at the third rod body 23 of the supporting unit 2. The backboard 3 has at least two plates 32, 32 and a backboard frame 33 between the two plate bodies 31, 32. One side of each plate body 31, 32 has a sleeve 311, 321. A pin 34 serves to connect the two sleeves 311, 321 so that the two plate bodies 31, 32 are combined. One surface of each plate body 31, 32 has a plurality of enhancing plates 35. A plurality of supporting bars 36 have one end connected to the enhancing plates 35 and another ends of the supporting bars 36 are connected to the third rod body 23. The hoop unit 33 of the backboard 3 is extended with a retaining portion 331 which is fixed between the two plate bodies 31, 32. Therefore, by above mentioned structure, a foldable basketball stand is formed.

Figure 7:
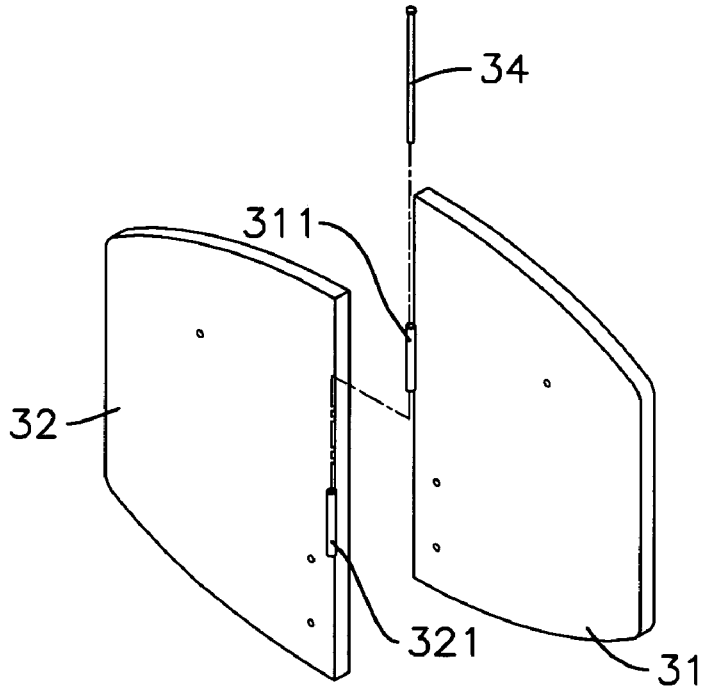
FIGS. 7 and 8 are assembled views about the two plate bodies of the present invention.
Figure 8:
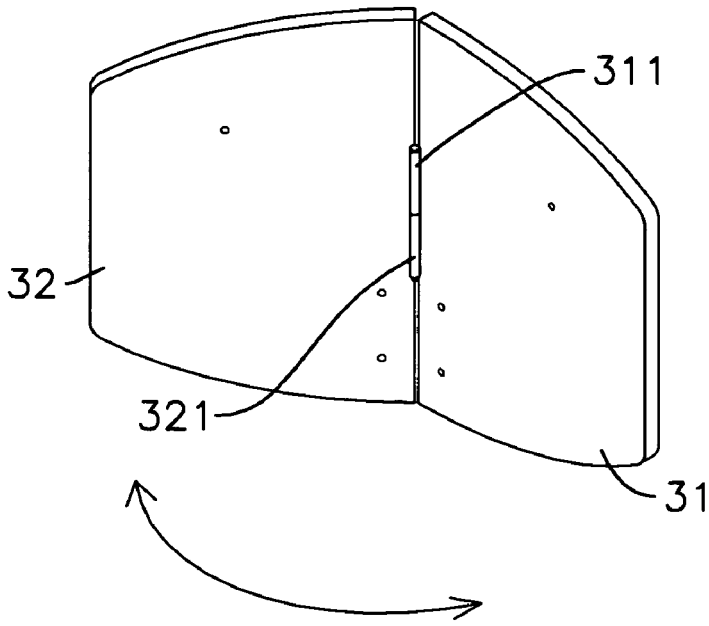
Figure 9:
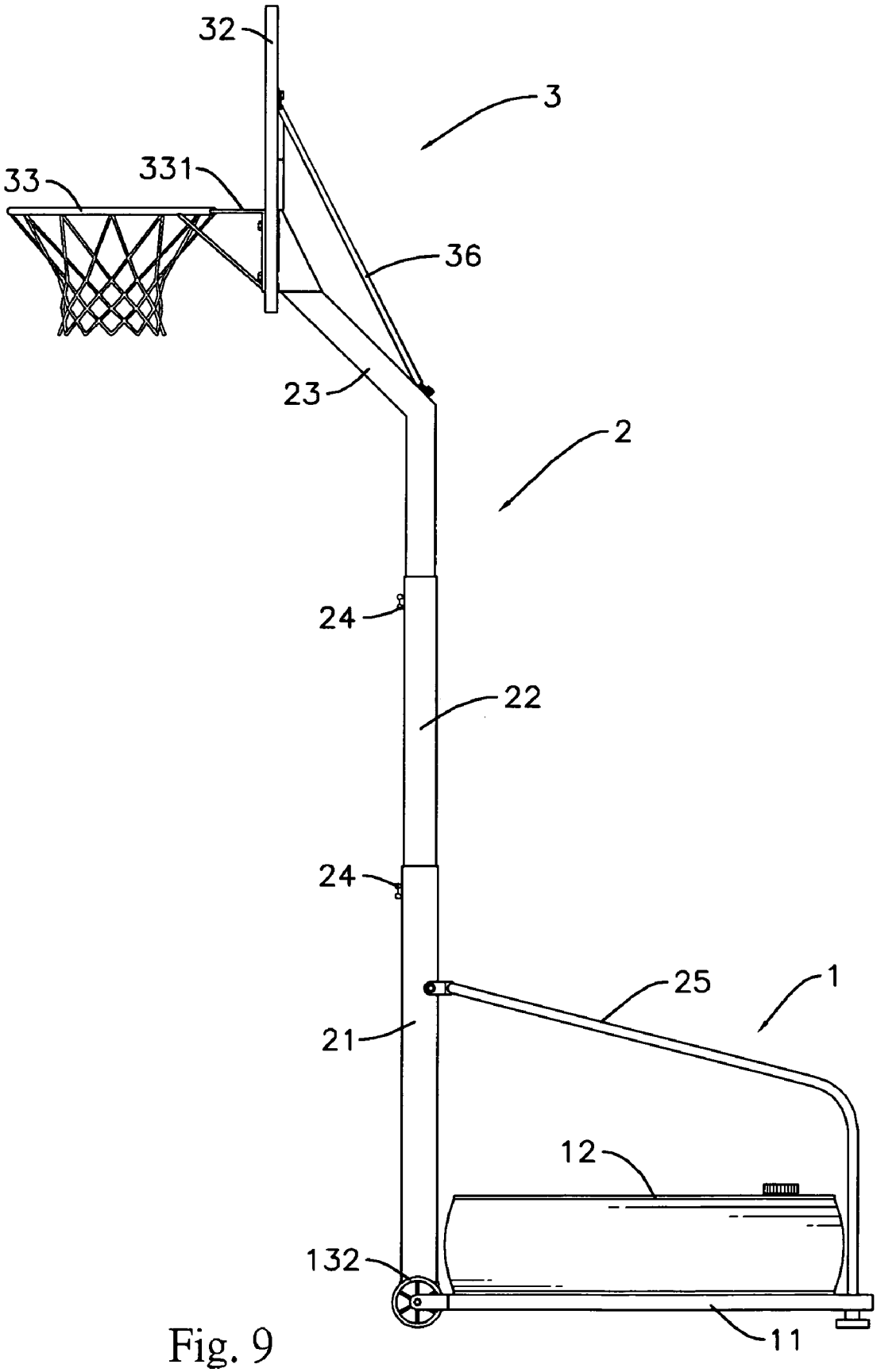
FIG. 9 is a lateral view of the present invention.

Referring to FIGS. 3 to 9, in assembly, the first rod body 21 of the supporting unit 2 is connected to the assembly portion 13 of the transfer unit 13 through a retainer 4. Then water is filled into the water inlet 121 of the weight 12. Then the weight 12 is placed upon the supporting frame 11 of the seat 1. The supporting bars 25 at two sides of the supporting frame 11 are connected to the first rod body 21 of the supporting unit 2 by using the retainer 4. Then pins 24 pass through the through holes 211, 221, 231 so as to connect the rod bodies 21, 22, 23. The length of the supporting unit 2 is adjusted.

Then a pin 34 is inserted into the sleeves 311, 321 of the plate bodies 31, 32 so that the plate bodies 31, 32 are foldable. Then the plate bodies 31, 32 are connected to the connection portion 232 of the third rod body 23. The enhancing plates 35 are installed to one surfaces of the plate bodies 31, 32 and the plurality of supporting bars 36 are secured to the plate bodies 31, 32 and are connected to the third rod body 23. Thereby the assembly of the present invention is completed.

After use, the retainers 4 for assembling the seat 1, supporting unit 2 and the backboard 3 are detached. The seat 1, supporting unit 2, backboard 3, supporting bars 36, 25, hoop 33, and enhancing plates 35 are detached. The rod bodies 21, 22, 23 are assembled for storage. Water in the weight 12 is released and the weight 12 is flattened. The plate bodies 31, 32 are overlapped. Thereby the foldable basketball stand is folded for storage.

Therefore, the foldable basketball stand of the present invention can improve the defects in the prior art. The installation of the seat, supporting unit and backboard causes the foldable basketball stand can be assembled easily for use and detached easily for storage. Thereby the volume of the foldable basketball stand is small. It can be storage and transferred easily and conveniently.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A foldable basketball stand comprising:

a seat having a supporting frame and a weight installed on the supporting frame and a transfer unit installed on the supporting frame; the weight being a water box formed of an upper hard plate, a lower hard plate, a middle soft plastic plate between the upper hard plate and the lower hard plate, and a water inlet in the upper hard plate; the middle soft plastic plate being compressible so that the water box is foldable to have a smaller volume; the transfer unit having a retaining rod; two ends of the retaining rod have wheels; a center of the retaining rod has an assembly portion;

a supporting unit formed of a plurality of rod bodies; the rod bodies being connectable one by one; one sides of the rod bodies being formed with respective through holes; pins serving to connect the rod bodies; one of the rod bodies at a lowest end being connected to the assembly portion of the transfer unit; one end of the third rod body being connected to a connection portion of a backboard; two sides of the supporting frame of the seat having respective supporting bars for being connected to the supporting unit;

a backboard installed at the third rod body of the supporting unit; the backboard being formed by two plates connected at a middle part of the backboard and a backboard frame between the two plate bodies; one side of each plate body having a sleeve; a pin serving to connect the two sleeves so that the two plate bodies are combined; a hoop unit of the backboard being extended with a retaining portion which is fixed between the two plate bodies wherein one surface of each plate body having a plurality of enhancing plates; a plurality of supporting bars have one end connected to the enhancing plates and another ends of the supporting bars are connected to one of the rod body at the upper end.

* * * * *